US005180355A

United States Patent [19]

Inoue

[11] Patent Number: 5,180,355

[45] Date of Patent: Jan. 19, 1993

[54] CARTONING APPARATUS

[75] Inventor: Katsuki Inoue, Ishikawa, Japan

[73] Assignee: Shibuya Kogyo Co., Ltd., Ishikawa, Japan

[21] Appl. No.: 748,021

[22] Filed: Aug. 21, 1991

[30] Foreign Application Priority Data

Aug. 22, 1990 [JP] Japan ..... 2-220378
Sep. 10, 1990 [JP] Japan ..... 2-239273

[51] Int. Cl.[5] ..... B31B 3/80; B31B 5/78

[52] U.S. Cl. ..... 493/315; 493/316; 493/453

[58] Field of Search ..... 493/123, 124, 125, 126, 493/127, 309, 315, 317, 318, 453

[56] References Cited

U.S. PATENT DOCUMENTS 2,762,274 9/1956 Kerr ..... 493/315
2,936,681 5/1960 Earp ..... 493/310
3,956,976 5/1976 Vogel et al. ..... 493/315
4,194,442 3/1980 Martelli ..... 493/315
4,871,348 10/1989 Komaka ..... 493/317
5,061,231 10/1991 Dietrich et al. ..... 493/315

FOREIGN PATENT DOCUMENTS 756890 9/1956 United Kingdom ..... 493/315

*Primary Examiner*—William E. Terrell
*Attorney, Agent, or Firm*—Flynn, Thiel, Boutell & Tanis

[57] ABSTRACT

Flat folded carton blanks with four end flaps are taken out of a carton magazine one by one by a takeoff mechanism. A carton blank thus taken out is delivered to a vacuum plate provided on the outer circumference of a rotary drum. While the carton blank is sucked to the vacuum plate and circularly transferred, it is knocked from the trailing side thereof by an unfolding guide so as to be set up. A flap, which is on the leading side in the direction of advance, of the carton unfolded to a cross-sectionally rectangular shape is bent outward by a tucker moving at a speed higher than that of the vacuum plate, and the other flaps are pressed at their inner surfaces against a fixed guide to also be bent outward.

8 Claims, 20 Drawing Sheets

CARTONING APPARATUS

BACKGROUND OF THE INVENTION

1. Field of the Invention

This invention relates to a cartoning apparatus adapted to unfold a flat folded carton blank to a cross-sectionally rectangular shape and turn up the flaps outward so that goods are stored easily in the interior of the resultant carton.

2. Description of the Prior Art

A cartoning apparatus adapted to suck and take out one by one flat folded carton blanks from a carton magazine in which a plurality of such carton blanks are held in a stacked state; suck the resultant carton blank from the other side by another sucker while the same carton blank is transferred and thus unfold the carton blank to a cross-sectionally rectangular shape; and thereafter turn up the flaps outward by a flap knocking means and guide members has already been known (Japanese Patent Laid-open No. 155030/1984).

In such a conventional carton setting apparatus, a means for taking out and transferring carton blanks is constructed so as to be moved forward and backward, and, therefore, it is difficult to increase the moving speed of this means.

SUMMARY OF THE INVENTION

Therefore, an object of the present invention is to provide a cartoning apparatus of a rotary type structure whereby flat folded carton blanks can be processed at a high speed.

This object is achieved by sucking and taking out one by one by a takeoff means a plurality of carton blanks stored in a carton magazine, delivering this carton blank to a transfer means provided on a rotary body, unfolding the carton blank by an unfolding guide during the rotary transfer of the same, turning up outward a flap, which is on the front side with respect to the rotational direction, of the carton blank by a tucker, and pressing the other flaps against a fixed guide and bending the same outward.

The above and other objects as well as advantageous features of the invention will become apparent from the following description of the preferred embodiments taken in conjunction with the accompanying drawings.

BRIEF DESCRIPTION OF THE DRAWING

FIGS. 8–11 illustrate a second embodiment, wherein:

FIG. 8 is a front elevation of a goods-inserting side flap bending mechanism;

FIG. 9 is a side elevation of the mechanism of FIG. 8;

FIG. 10 is a non-goods-inserting side flap bending mechanism; and

FIG. 11 is a side elevation of the mechanism of FIG. 10;

FIGS. 12–14 illustrate another example of the carton takeoff unit, wherein:

FIG. 12 is a front elevation;

FIG. 13 is a plan view; and

FIG. 14 is an enlarged view of a principal portion of what is shown in FIG. 12.

DESCRIPTION OF THE PREFERRED EMBODIMENTS

Figure 1:
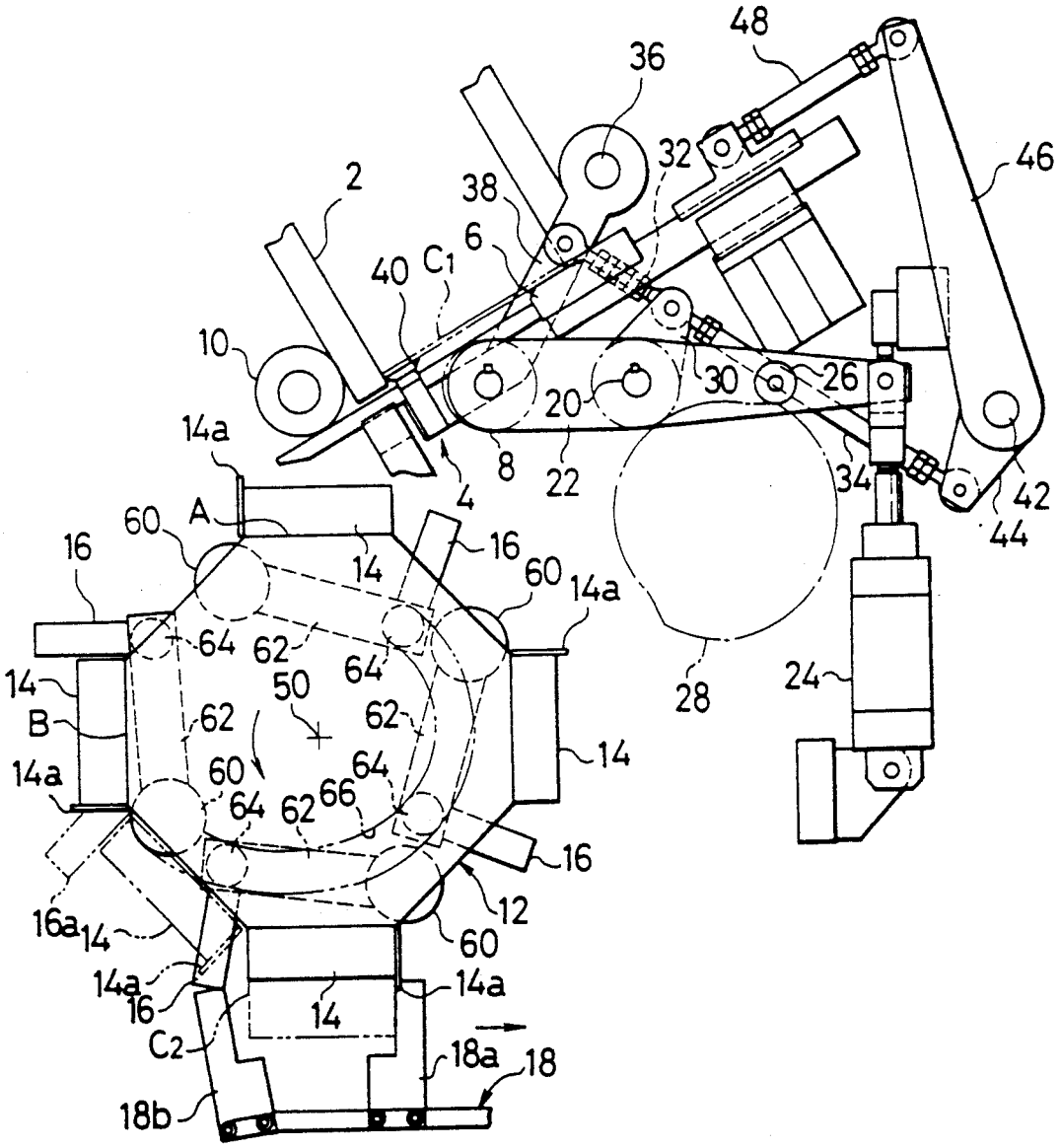
FIG. 1 is a front elevation of a takeoff unit and an unfolding unit in an embodiment of the carton setting apparatus according to the present invention.

The present invention will now be described with reference to the illustrated embodiments thereof. FIG. 1 is a front elevation of an embodiment of the cartoning apparatus according to the present invention, which is provided with a carton magazine 2 holding a plurality of flat folded carton blanks $C_1$ in a stacked state, a takeoff mechanism 4 adapted to take out the carton blanks $C_1$ one by one from the carton magazine 2, a kicker 6 adapted to kick out a carton blank $C_1$, which has thus been taken out, in the forward direction (leftward in the drawing), rollers 8, 10 adapted to be rotated as they hold a kicked-out carton blank $C_1$ from the upper and lower sides thereof and send out the same carton blank $C_1$ forward, vacuum plates 14 which are arranged at regular intervals around the outer circumference of a rotary drum 12 provided below the front roller 10, and which are adapted to suck, retain and transfer the carton blanks $C_1$ sent out by rollers 8, 10, unfolding guides 16 adapted to knock and raise the carton blanks $C_1$, which are suction-retained and transferred circularly by the vacuum plates 14, from the rear sides thereof, flap-bending tuckers 17 and fixed guides 19 (refer to FIG. 2), each carton blank $C_1$ being set to a cross-sectionally rectangular cylindrical shape by these means, the flaps of the resultant carton being then bent, the carton being thereafter delivered to carton fingers 18*a*, 18*b* of a carton conveyor 18 disposed below the rotary drum 12.

The roller 8 positioned below the carton magazine 2 is supported rotatably on one end portion of a roller support lever 22 which is pivotable around a shaft 20 as a fulcrum. A rod in an air cylinder 24 is joined to the other end portion of the roller support lever 22, and a cam follower 26 is provided between the air cylinder 24 and fulcrum shart 20. The cam follower 26 contacts a plate cam 28 owing to the effect of the air cylinder 24 which is similar to that of a tension spring, and the lower roller 8 is swung vertically in FIG. 1 in accordance with the rotation of the plate cam 28.

A shorter lever 30 which is other than the lever 22 is fixed to the fulcrum shaft 20, and shorter and longer rods 32, 34 extending in the opposite directions are connected to this shorter lever 30. The upper shorter rod 32 is joined at its outer end portion to the portion of a bent lever 38 pivotable around a fulcrum 36 which is closer to the fulcrum 36. A sucker 40 is held on the free end portion of this bent lever 38 so that the angle of inclination of the sucker 40 is substantially equal to that of the carton magazine 2, to constitute a takeoff mechanism 4.

The lower longer rod 34 is joined at its outer end portion to a shorter lever 44 which is pivotable around a shaft 42 as a fulcrum, and a longer lever 46 is fixed to this fulcrum shaft 42 and moved pivotally together with the shorter lever 44. A rod 48 to which the kicker 6 adapted to be moved forward and backward along a lower takeoff surface of the carton magazine 2 is fixed is joined to the outer end portion of this longer lever 46.

The plate cam 28 has a larger-diameter arcuate periphery extending over substantially a half of the circumference thereof, and a smaller-diameter arcuate periphery extending over the remaining half of the circumference thereof. When the cam follower 26 is in contact with the larger-diameter portion of the plate cam 28, the portion of the roller support lever 22 which is on the side of the cam follower 26 is raised, and the lower roller 8 at the end of the lever 22 which is farther from the cam follower 26 is moved down. The shorter lever 30 fixed to the fulcrum shaft 20 to which the roller support lever 22 is also fixed is turned leftward in the drawing, and the bent lever 38 holding the sucker 40 is turned up via the shorter rod 32 to lift the sucker 40. In accordance with the pivotal movement of the shorter lever 30, the longer rod 34 is also moved to left in the drawing, so that the shorter and longer levers 44, 46 fixed to the fulcrum shaft 42 are also turned so as to move the kicker 6 back (rightward in the drawing).

When the cam follower 26 is in contact with the smaller-diameter portion of the plate cam 28, the cam follower 26 lowers in contrast to the above-mentioned case, and the lower roller 8 moves up to cause the sucker 40 to lower and the kicker 6 to move forward.

A rotary drum 12 adapted to be rotated around a horizontal shaft 50 is provided below the upper roller 10. The rotary drum 12 is provided on its outer circumferential surface with four vacuum plates 14 spaced at 90° intervals. Each vacuum plate 14 is provided on its front end portion with respect to the rotational direction of the drum 12 with a stopper 14*a* so that the stopper 14*a* extends at right angles to the outer surface of the plate 14. The vacuum plate 14 is provided with a plurality of suction holes therein and is adapted to suck and transfer the carton blank $C_1$ which has been sent out by the roller 8, 10.

The rotary drum 12 is further provided thereon with four carton blank unfolding guides 16 correspondingly to the vacuum plates 14. Each unfolding guide 16 is attached to the free end portion of an arm 62, which is adapted to be turned around a fulcrum shaft 60 provided at the portion of the rotary drum 12 which is slightly on the inner side of the corresponding stopper 14*a*, in such a manner that the unfolding guide 16 extends at right angles to the arm 62. A cam follower 64 provided on the inner side of a crossing portion of the arm 62 and unfolding guide 16 is engaged with a groove cam 66, so that the cam follower 64 advances arcuately as it is rotated in accordance with the rotation of the rotary drum 12. The groove cam 66 is shown with a part thereof omitted is FIG. 1.

Figure 2:
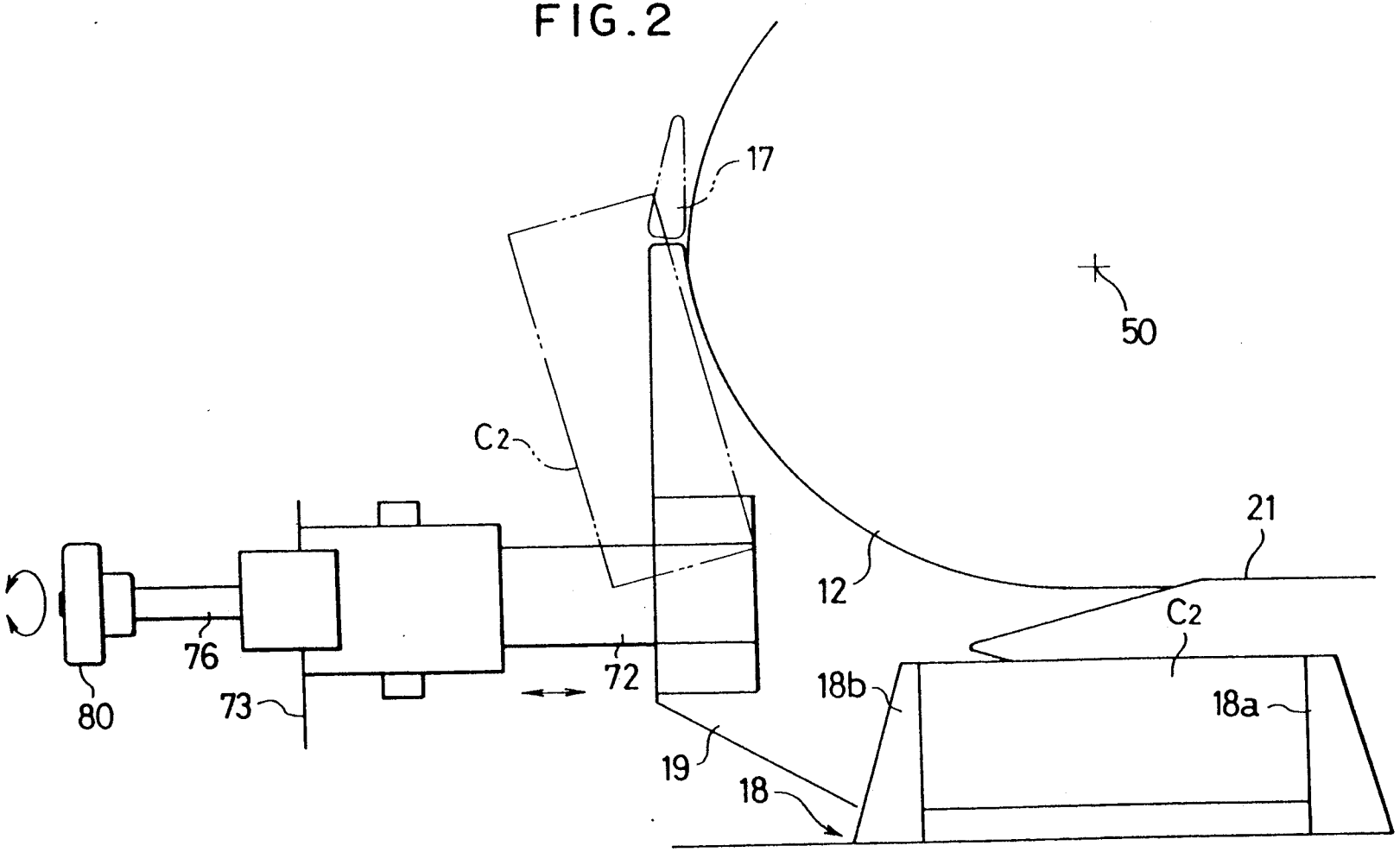
FIG. 2 is a front elevation of a goods-inserting side protion of a flap processing unit.
Figure 3:
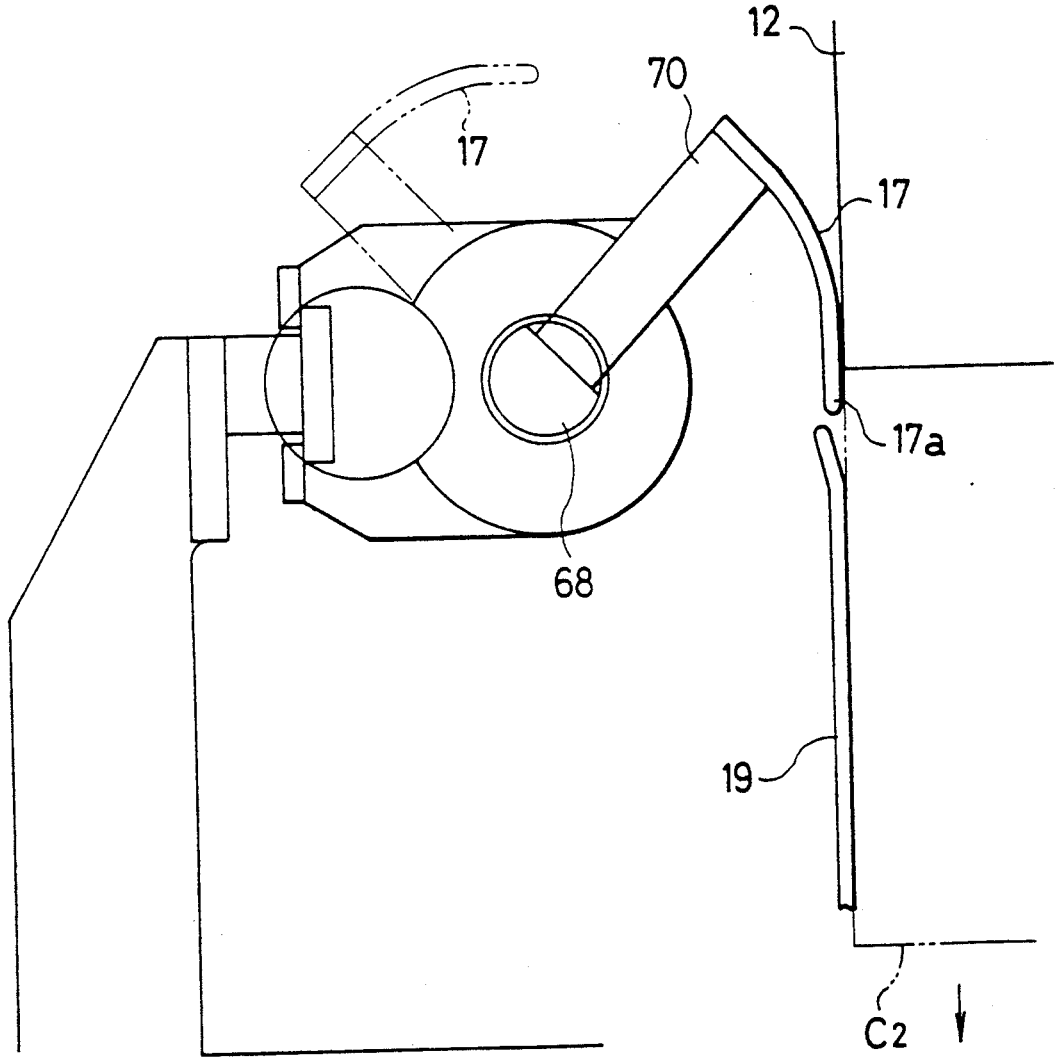
FIG. 3 is a side elevation of a principal portion of what is shown in FIG. 2.
Figure 4:
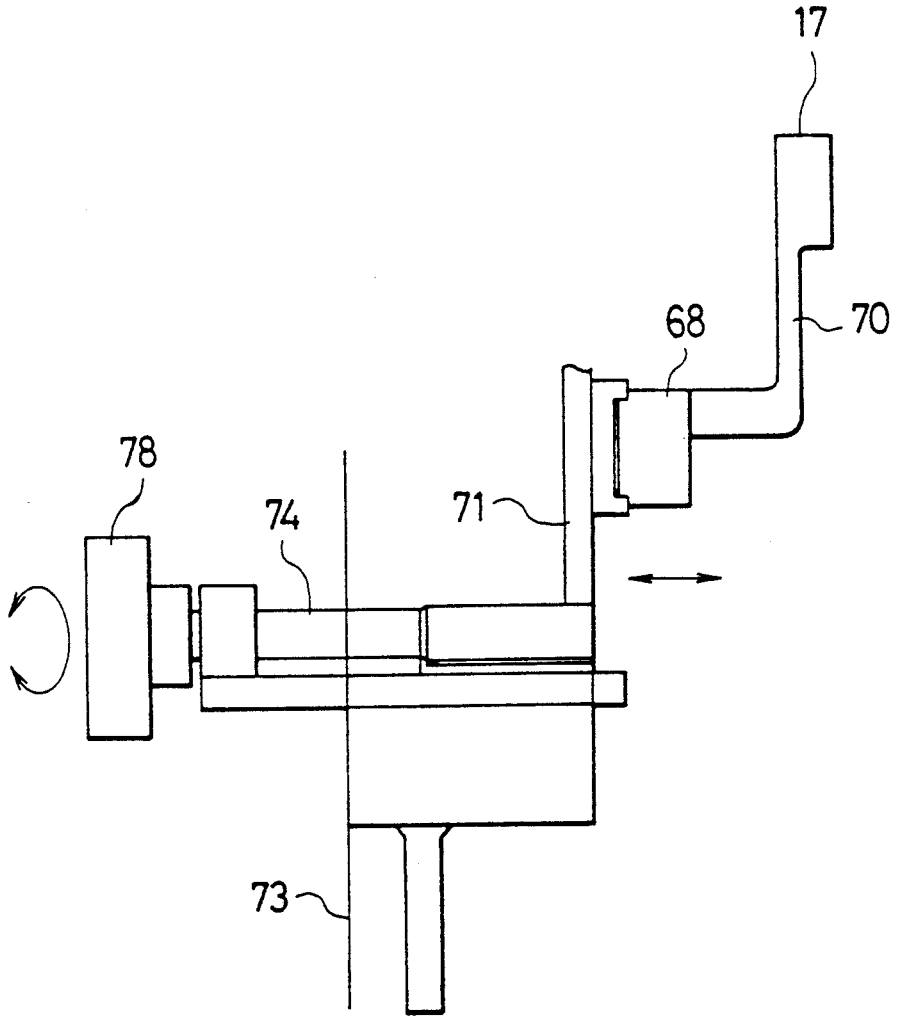
FIG. 4 is a plan view of a tucker.

FIGS. 2–4 show a tucker 17 for turning up outward a flap provided at a goods-inserting side opening in a carton $C_2$ unfolded to a cross-sectionally rectangular shape, and a fixed guide 19, and they are provided in a space which is on this side of the portion of the surface of FIG. 1 which is in the vicinity of the rotary drum 12. The tucker 17 is provided in a position B which is spaced at about 90° in the counter-clockwise direction from a position A in which a vacuum plate 14 receives a carton blank $C_1$, and it is fixed via an arm 70 to a rotary shaft 68 disposed at right angles to the shaft 50 of the rotary drum 12. As shown in FIG. 3, the tucker 17 has a substantially arcuate shape, and is adapted to be turned forward and backward between turning position (shown by solid lines in FIG. 3) in which a free end portion 17*a* of the tucker 17 comes closest to and becomes substantially parallel to the side surface of the rotary drum 12, and a standby position (shown by two-dot chain lines in the same drawing).

The guide 19 is disposed so as to extend from a position in which the guide 19 is opposed to the free end portion 17*a* of the tucker 17 which has been turned closest to the rotary drum 12, toward the carton conveyor 18 on the lower side thereof so that the guide 19 becomes substantially arcuate with the width thereof increasing gradually in the downward direction.

The mount members 71, 72 for the tucker 17 and fixed guide 19 are engaged with screw shafts 74, 76 supported rotatably on a machine frame 73. Accordingly, the positions of the tucker 17 and guide 19 can be regulated in accordance with the size of a carton by turning handles 78, 80.

Figure 5:
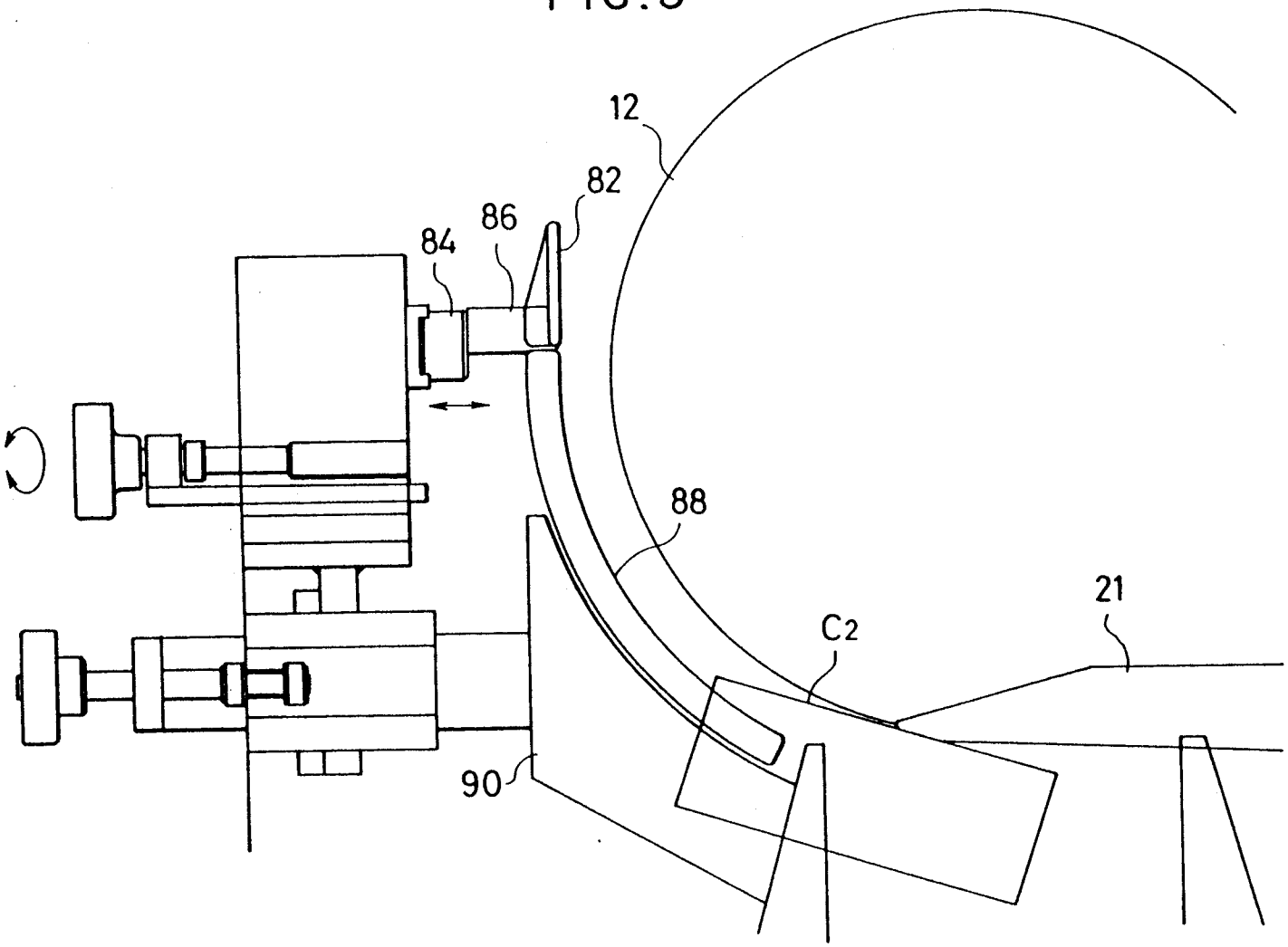
FIG. 5 is a front elevation of a non-goods-inserting side portion of the flap processing unit.
Figure 6:
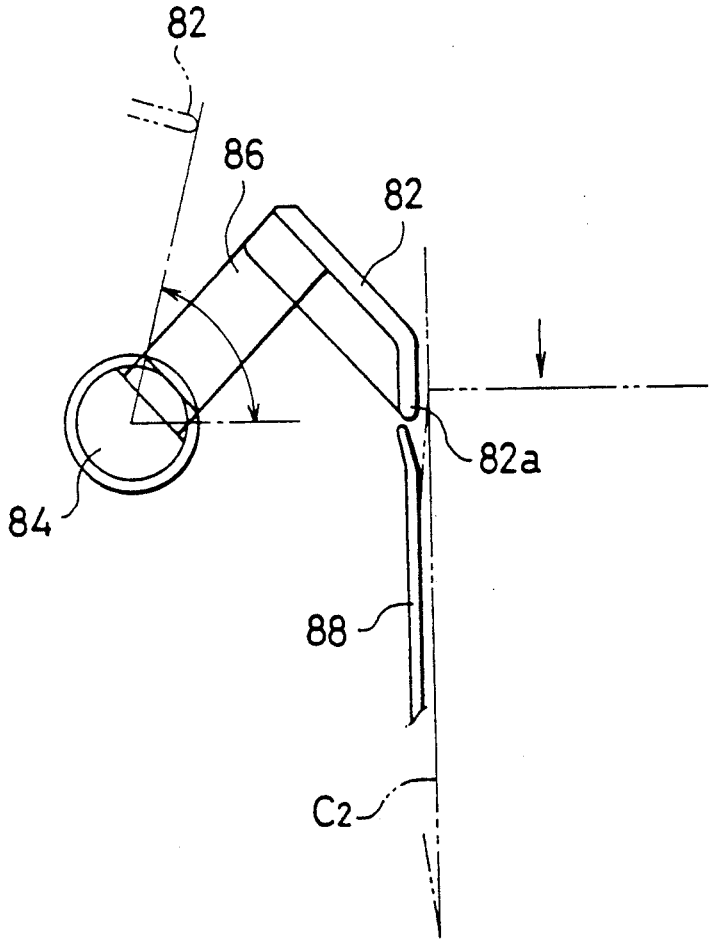
FIG. 6 is side elevation of a principal portion of what is shown in FIG. 5.

FIGS. 5 and 6 illustrate a tucker 82 for inwardly folding the flaps at a non-goods-inserting side opening in the carton $C_2$. and this tucker 82 is provided on the rear side of the surface of FIG. 1. Similarly to the above-mentioned tucker 17 on the goods-inserting side of the carton, the tucker 82 is provided in the vicinity of a position B which is spaced at round 90° from a position A in which the relative vacuum plate 14 receives a carton blank $C_1$, and it is fixed to a rotary shaft 84 via an arm 86 and adapted to be turned forward and backward between a position in which the tucker 17 comes close to the side surface of the rotary drum 12 and a standby position.

On the non-goods-inserting side of a carton, a side flap guide 88 and a lower flap bending guide 90 are provided. The side flap guide 88 extends arcuately in the downward direction from a position which is opposed to a free end 82*a* of the tucker 82 which has been turned closest to the rotary drum 12. The lower flap bending guide 90 is provided below the side flap guide 88, and the upper portion of the guide 90 is formed widely along the arcuate edge of the guide 88.

A carton conveyor 18 adapted to hold a carton $C_2$, which has been unfolded to a cross-sectionally rectangular cylindrical shape with its flaps bent, between a pair of carton fingers 18*a*, 18*b* and transfer this carton while retaining the unfolded state thereof is provided below the rotary drum 12. An upper side holding guide 21 for preventing the unfolded carton $C_2$ from floating due to the repulsive force thereof is provided above the carton conveyor 18.

OPERATION

The operation of the cartoning apparatus of the above-mentioned construction will now be described. First, the cam follower 26 fixed to the roller support lever 22 is pushed onto the larger-diameter portion of the plate cam 28 to lower the portion of the roller support lever 22 which is on the side of the roller 8 and move up the sucker 40 in the takeoff mechanism 4, so that a carton blank $C_1$ in the carton magazine 2 is sucked. During this time, the kicker 6 is in a retreated state.

When the cam follower 26 changes to be on the smaller-diameter portion of the plate cam 28 due to the rotation of the latter member, the sucker 40 lowers to take out a carton blank $C_1$. At the same time, the lower roller 8 is moved up to contact the lower surface of the carton blank $C_1$, and the kicker 6 advances leftward in FIG. 1 along the opened surface of the carton magazine 2. The carton blank $C_1$ is pressed from behind by the kicker 6 as it receives a counter-clockwise rotational force from the lower roller, to be sent forward.

A vacuum plate 14 is turned to a position corresponding to the upper portion of the rotary drum 12, in such a manner that the vacuum plate 14 meets with the carton blank $C_1$ just sent out, and the carton blank $C_1$ is delivered to this vacuum plate 14. The vacuum plate 14 is provided at the front side thereof in the rotational direction of the drum 12 with a stopper 14*a*, upon which the front end of the carton blank $C_1$ impinges, so that the carton blank $C_1$ is positioned. At this time, a vacuum pressure works in the suction holes mentioned above, to start the suction of the carton blank $C_1$. When the carton blank $C_1$ fully contacts the surface of the vacuum plate 14 while the rotary drum 12 is further turned, it is adsorbed completely to the vacuum plate 14.

Figure 7A:
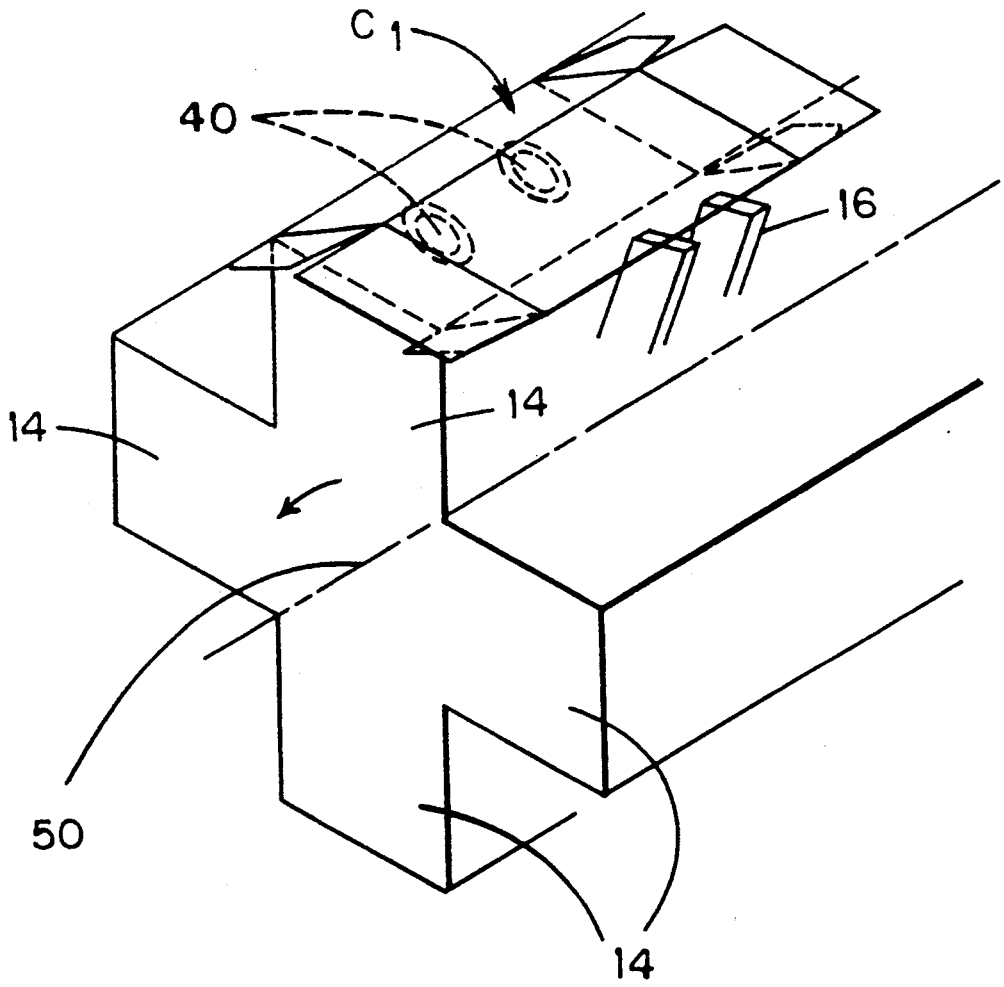
FIGS. 7A–7G are sequential schematic illustrations of the carton unfolding and flap manipulation structure, FIG. 7D being a perspective view of a carton set by the above apparatus.
Figure 7B:
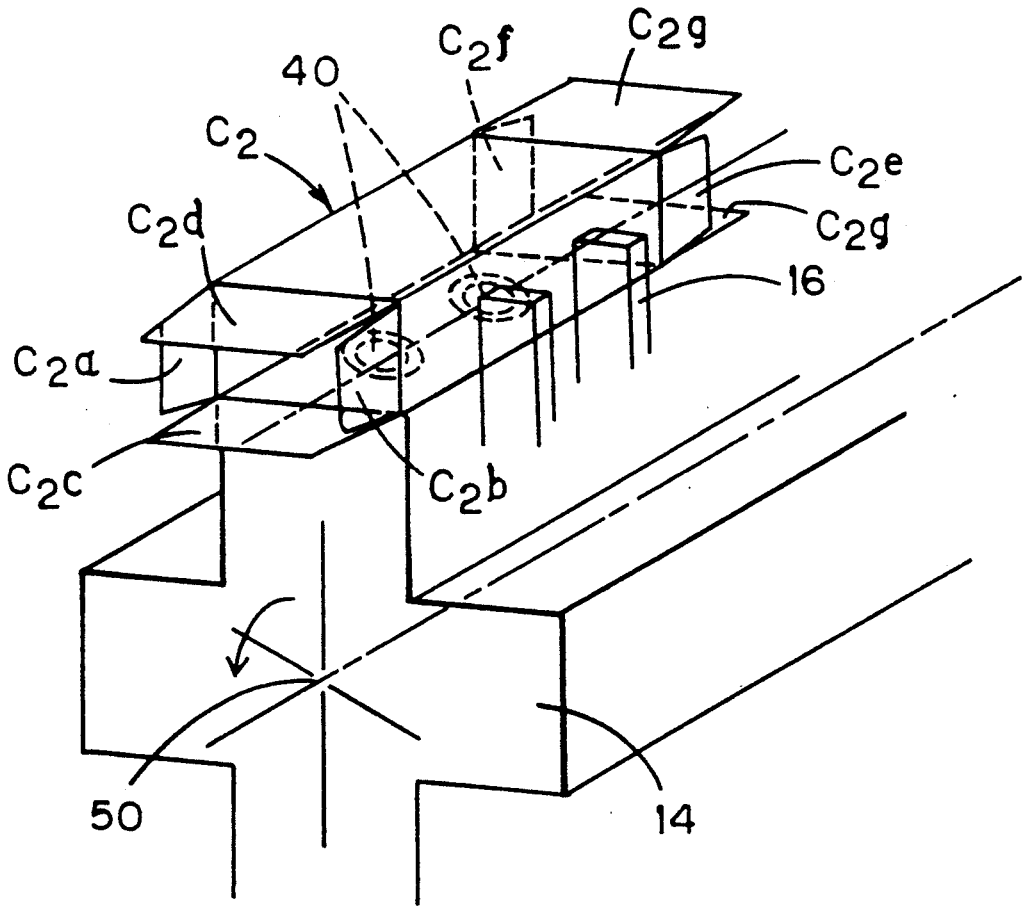

While the carton blank $C_1$ is thereafter transferred substantially 90° from the A-position to the B-position as it is adsorbed to and retained by the vacuum plate 14, it is unfolded by the unfolding guide 16 (see FIG. 7A). The unfolding guide 16 is turned circularly by the rotary drum 12 and swung by the groove cam 66 to knock the carton blank $C_1$ from behind, whereby the carton blank $C_1$ is unfolded and formed into a cross-sectionally rectangular carton $C_2$ (see FIG. 7B). As shown in FIG. 1, the vacuum plate 14 and unfolding guide 16 are at substantially right angles to each other in the position B to complete the unfolding of the carton blank $C_1$.

Figure 7C:
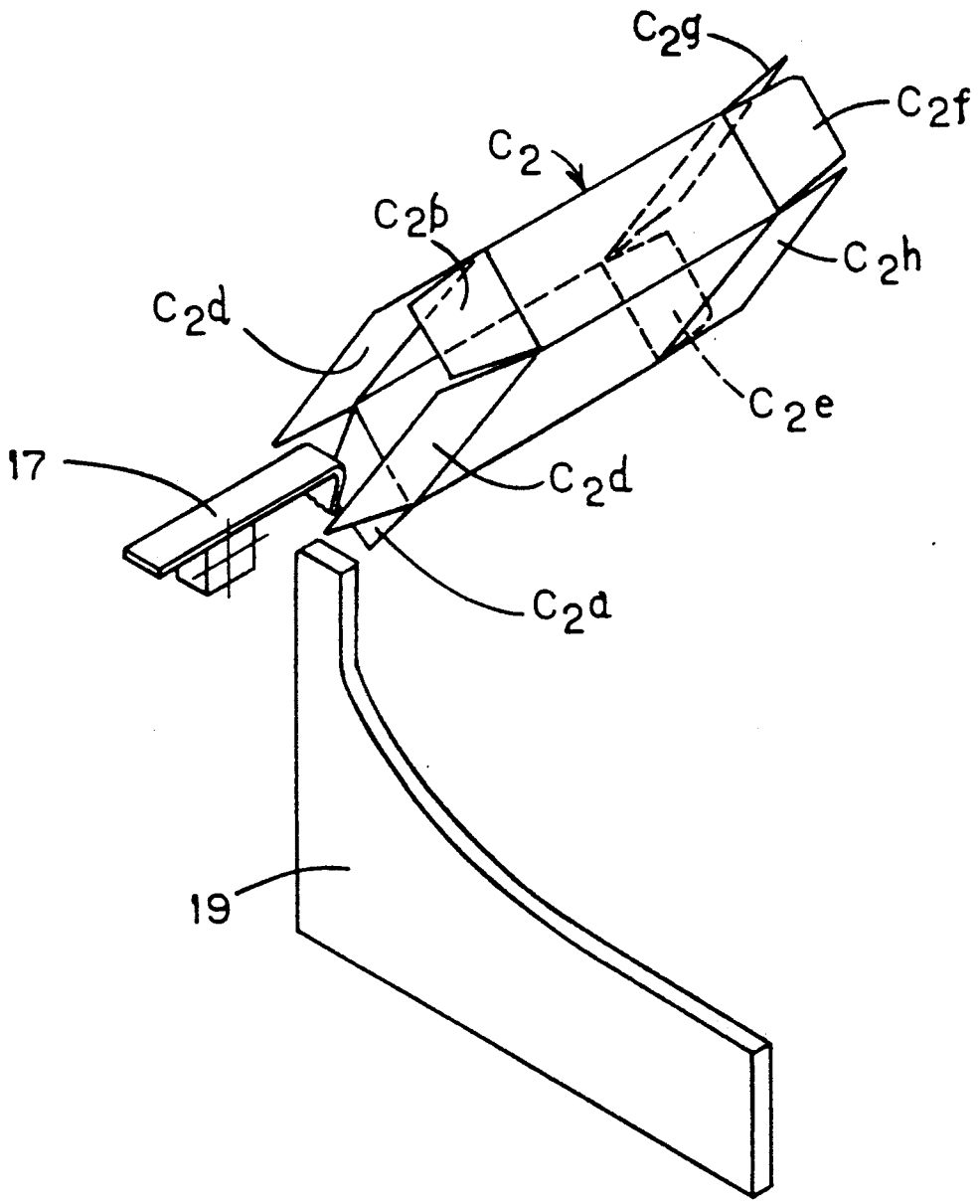
Figure 7D:
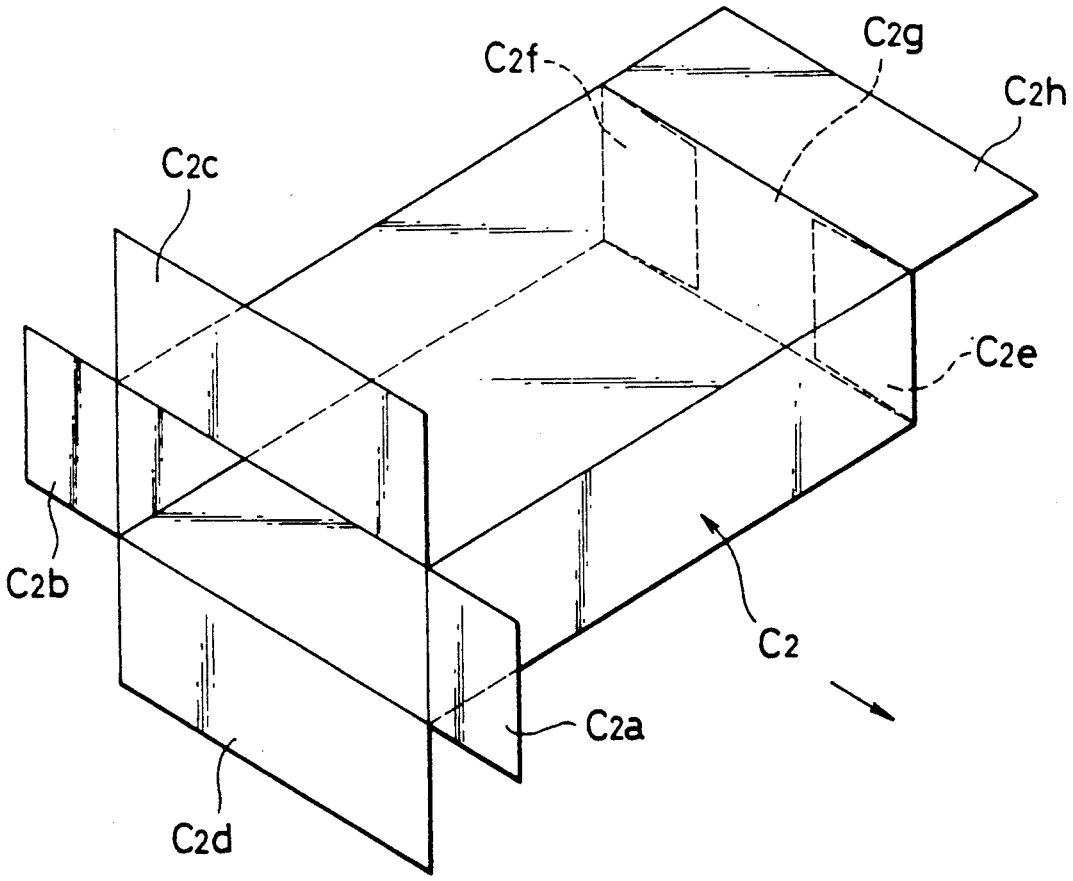

A tucker 17 (see FIG. 7C) and fixed guide 19 are provided in the position on the goods-inserting side which is in the vicinity of the position B in which the unfolding of the carton blank is completed. A side flap $C_2a$ on the leading side in the direction of advance of the cross-sectionally rectangular carton $C_2$ (refer to FIG. 7D) sucked to and retained by the vacuum plate 14 is knocked from the inner side to be bent outward by the tucker 17 and held as it is in the fixed guide 19, while a side flap $C_2b$ on the trailing side in the direction of advance of the carton $C_2$ and upper and lower flaps $C_2c$, $C_2d$ thereof are folded back in the outward direction by the fixed guide 19 (see FIG. 7A).

Figure 7E:
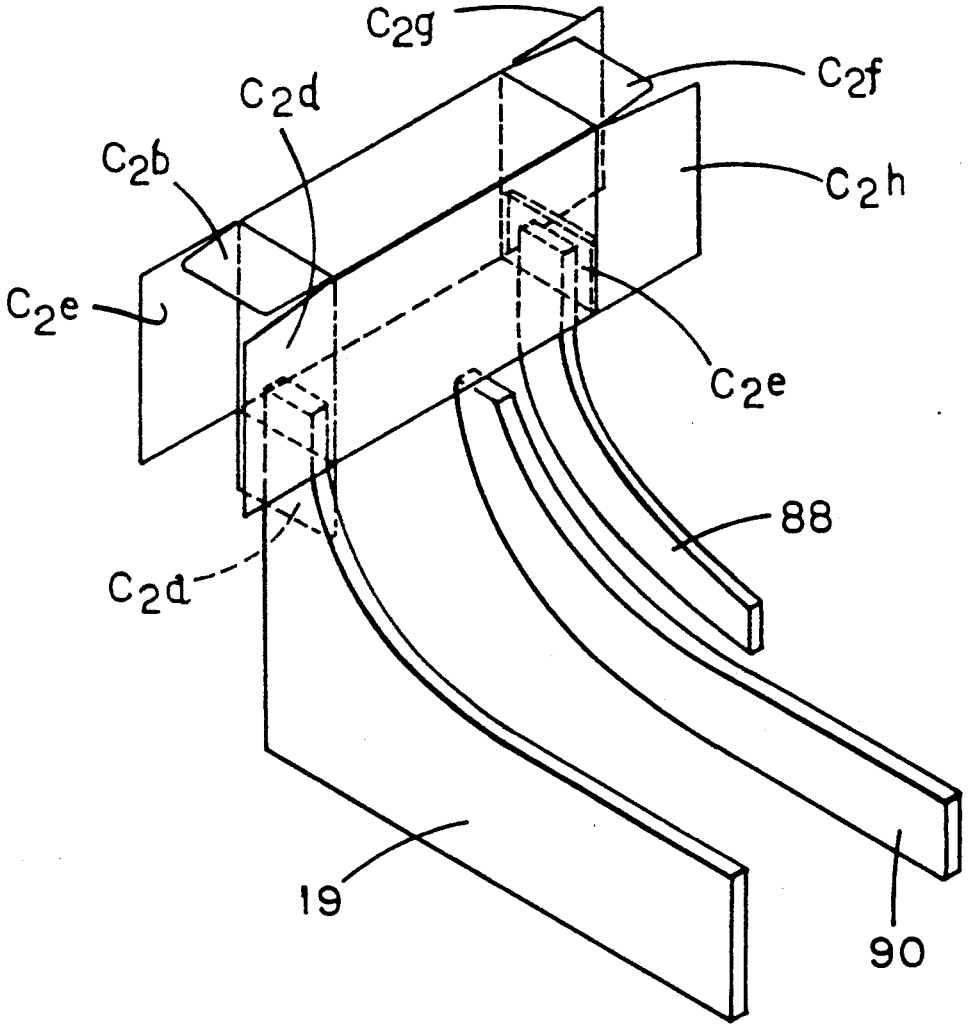
Figure 7F:
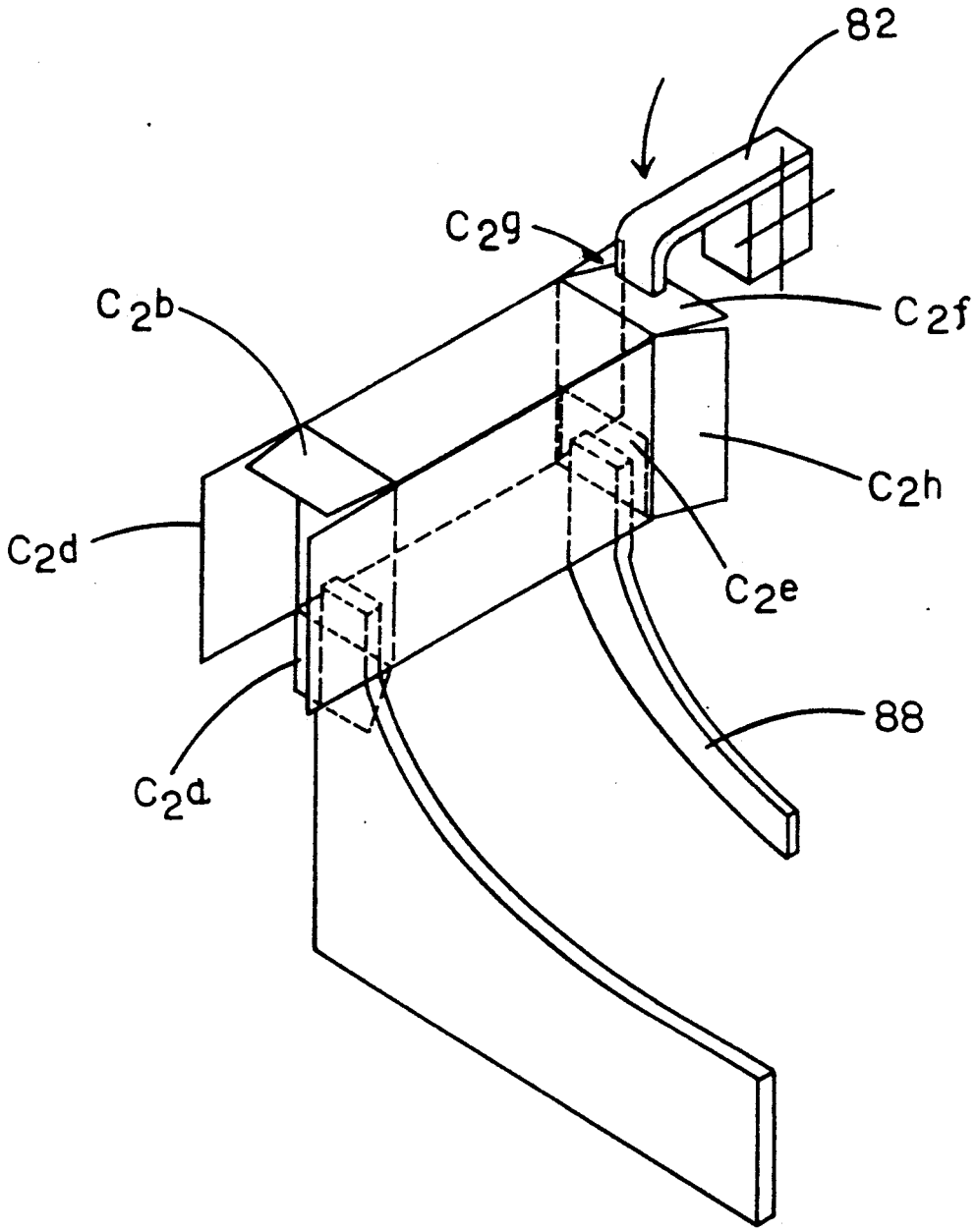
Figure 7G:
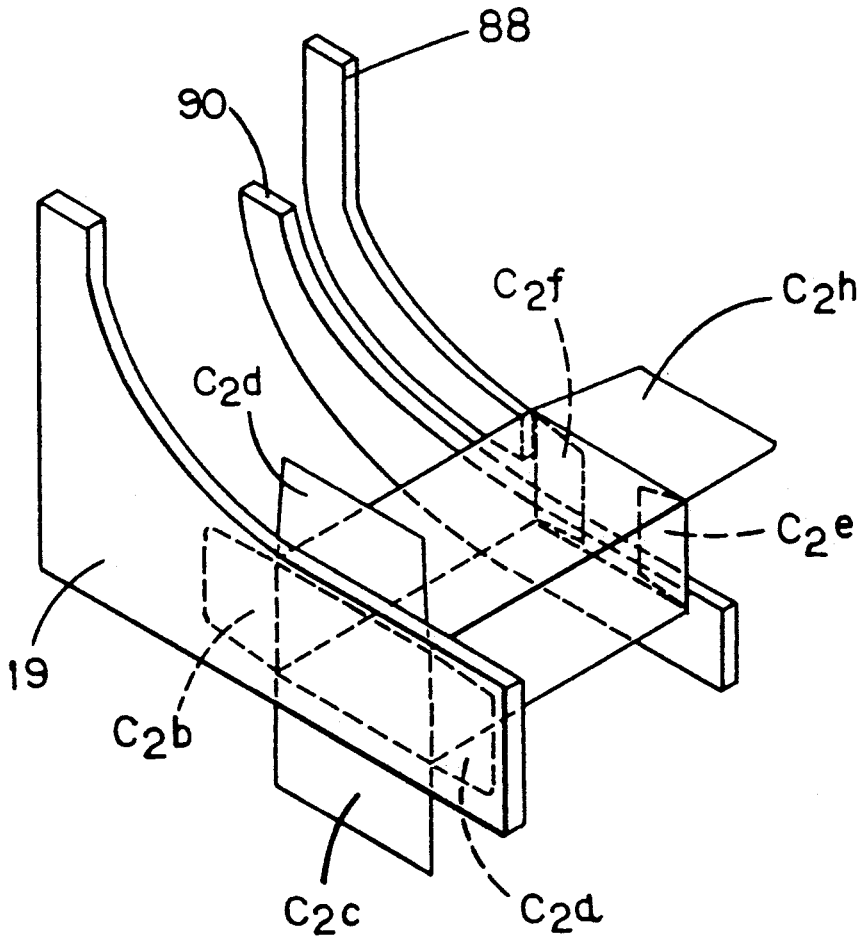

A tucker 82, a side flap guide 88 and an outer flap bending guide 90 are provided in the space on the non-goods-inserting side which is in the vicinity of the position B (see FIG. 7E), and, on this side, a side flap $C_2e$ on the front side in the direction of advance of the carton $C_2$ impinges upon the side flap guide 88 to be bent inward, while a side flap $C_2f$ on the trailing side in the direction of advance of the carton $C_2$ (see FIG. 7F) is knocked from the outside by the tucker 82 to be bent inward and held in the side flap guide 88. A flap $C_2g$ positioned on the lower side is also folded inward by a lower flap bending guide 90 (see FIG. 7A). An upper flap $C_2h$ remains as it is.

The carton $C_2$ unfolded to a cross-sectionally rectangular shape with the flaps $C_2a$–$C_2h$, which are on the goods-inserting and non-goods-inserting side openings thereof, bent as shown in FIG. 7 is delivered to the carton fingers 18*a*, 18*b* of the carton conveyor 18 provided below the rotary drum 12, and it is then sent to a subsequent stage.

The carton blank unfolding and flap bending operations are thus carried out while the transfer means adapted to receive and transfer a carton blank taken out from the carton magazine makes substantially a half turn, and the unfolded carton is then delivered to the carton conveyor. This enables the construction, dimensions and operation speed of the cartoning apparatus to be simplified, reduced and increased, respectively.

FIGS. 8–11 illustrate a second embodiment of the cartoning apparatus. This apparatus also provided with a plurality (for example, four) of vacuum plates 114 on the outer circumference of a rotary drum 112 in the same manner as the previously-described embodiment. While each vacuum plate 114 sucks and circularly transfers a carton $C_2$ unfolded to a cross-sectionally rectangular shape, the flaps $C_2a$, $C_2b$, $C_2c$, $C_2d$, $C_2e$, $C_2f$, $C_2g$ at the opened portions on both sides of the carton $C_2$ are bent. The operation for unfolding the carton blank to a cross-sectionally rectangular shape is carried out by the same unfolding guide as mentioned previously or some other means.

At one opened portion of the carton $C_2$, the flaps $C_2a$, $C_2b$, $C_2c$, $C_2d$ are bent outward for inserting goods into the interior of the carton $C_2$, and, at the other opened portion thereof, the flaps $C_2e$, $C_2f$, $C_2g$ are bent inward to close the opening.

Figure 8:
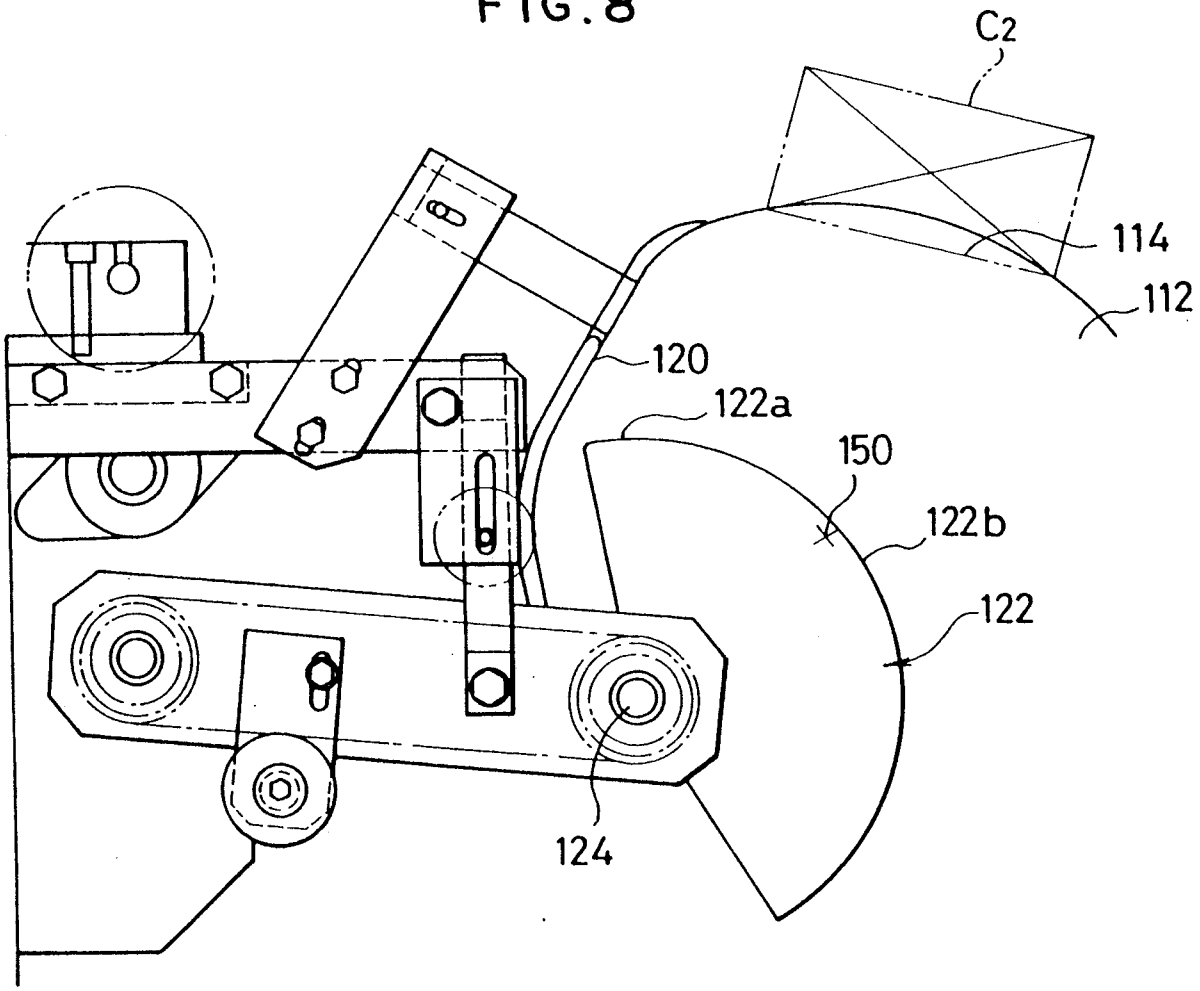
Figure 9:
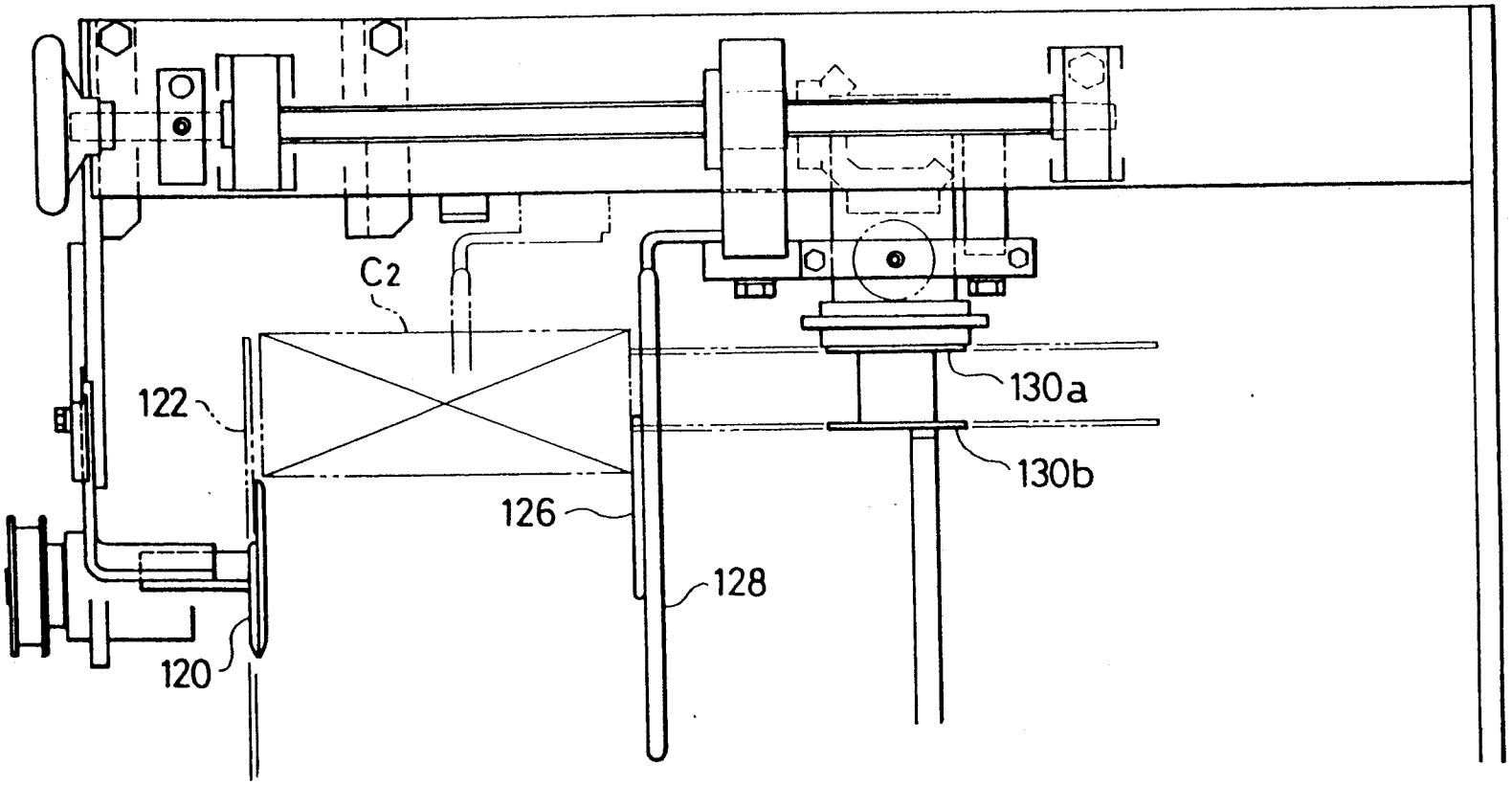

FIG. 8 shows a structure for bending the flaps $C_2a$, $C_2b$, $C_2c$, $C_2d$ at the goods-inserting side opening in a carton, in which a guide 120 for bending the lower flap $C_2d$ outward and an open tucker 122 for bending the side flaps $C_2a$, $C_2b$ on the front and rear sides in the direction of advance of the carton are provided on one side of the path of the carton $C_2$ (refer to FIG. 9).

The lower flap bending guide 120 is provided with its front end portion positioned slightly outside of a path of a vacuum plate 114 and its portion which continues from the front end portion extending gradually toward a position slightly inside of the same path, in such manner that the guide 120 enters the inner side of the lower flap $C_2d$ substantially when the carton $C_2$ sucked to the vacuum plate 114 turning around a drum shaft 150 has reached the highest position.

The open tucker 122 consists of a substantially semicircular plate, and is capable of being turned around a horizontal shaft 124 provided below the lower flap bending guide 120. The open tucker 122 starts being turned when the carton $C_2$ is moved toward the same with the lower flap $C_2d$ bent outward by the guide 120; bends outward at its front end portion 122*a* the upper flap $C_2c$ and the side flap $C_2a$ on the front side in the direction of advance of the carton; and further turns in accordance with the movement of the carton $C_2$ to bend outward at its substantially intermediate portion 122*b* the side flap $C_2b$ on the rear side in the direction of advance of the carton.

Figure 10:
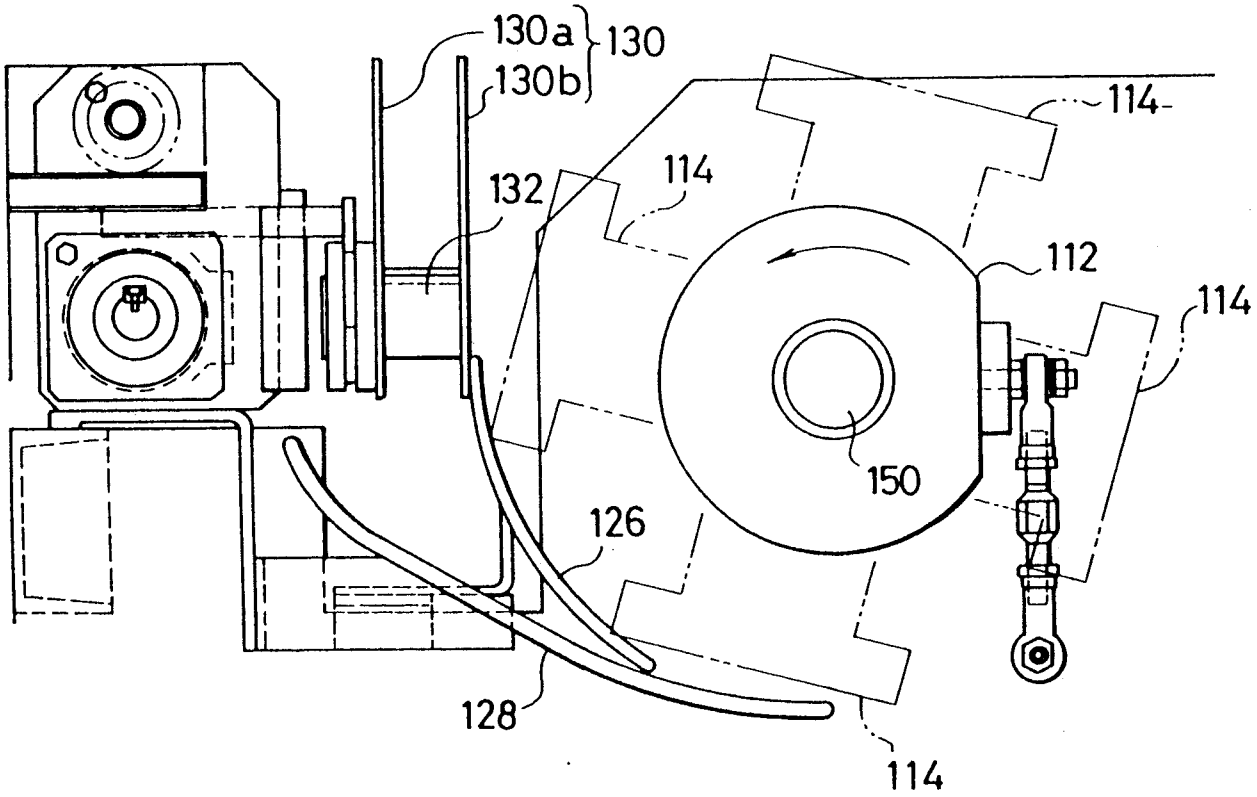
Figure 11:
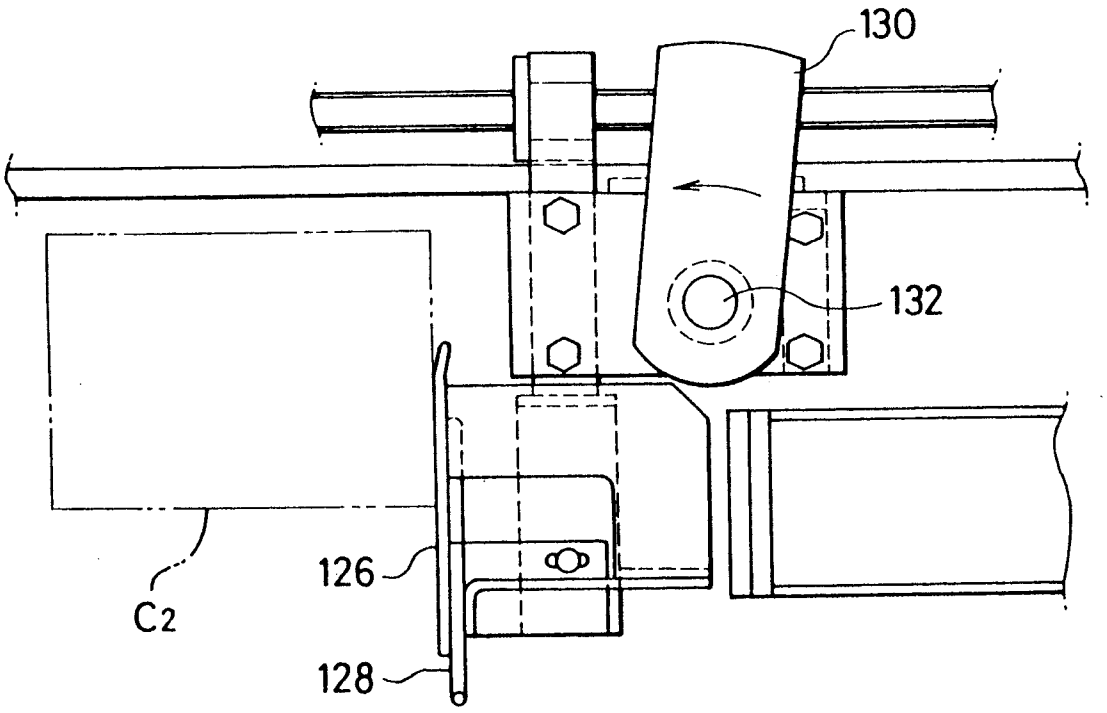

FIG. 10 shows a structure for bending the non-goods-inserting side flaps $C_2e$, $C_2f$, $C_2g$, the structure being provided with a front flap bending guide 126 for bending the side flap $C_2e$ on the front side in the direction of advance of the carton, a guide 128 for bending the lower flap $C_2g$, and a flap tucker 130 for bending the side flap $C_2f$ on the rear side in the direction of advance of the carton.

The front flap bending guide 126 is formed arcuately so as to extend substantially along the path of the vacuum plate 114. The flap tucker 130 is provided slightly above the upper end of this front flap bending guide 126, and has a pair of arms 130*a*, 130*b* adapted to be turned around a shaft 132 extending at right angles to the drum shaft 150. The flap tucker 130 is adapted to be turned from the rear side of the carton $C_2$, which is in turning motion, at a speed higher than that of the carton $C_2$ to bend the side flap $C_2f$ on the rear side in the direction of advance of the carton $C_2$. The bent rear side flap $C_2f$ is held by the front flap bending guide 126 and advances forward.

Figure 12:
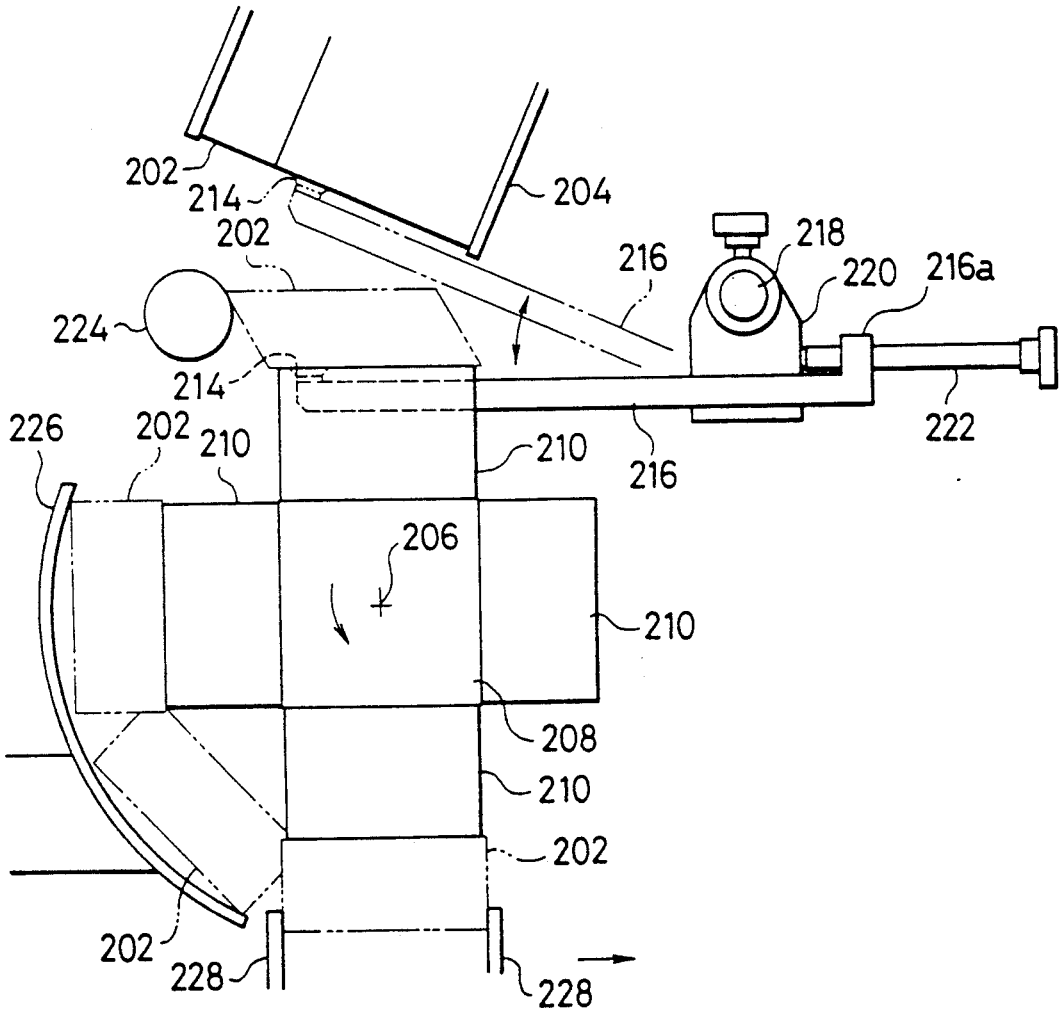
Figure 13:
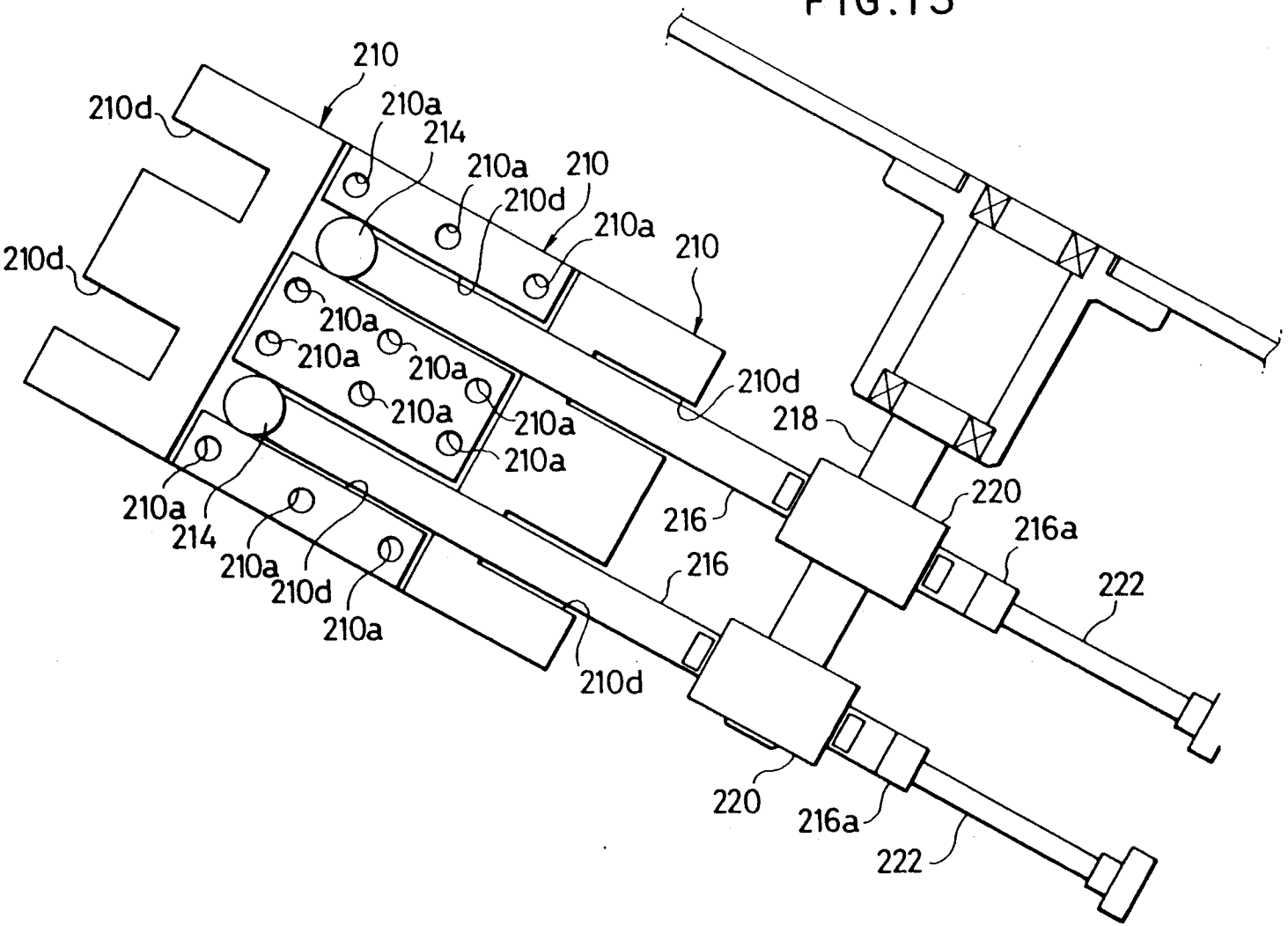
Figure 14:
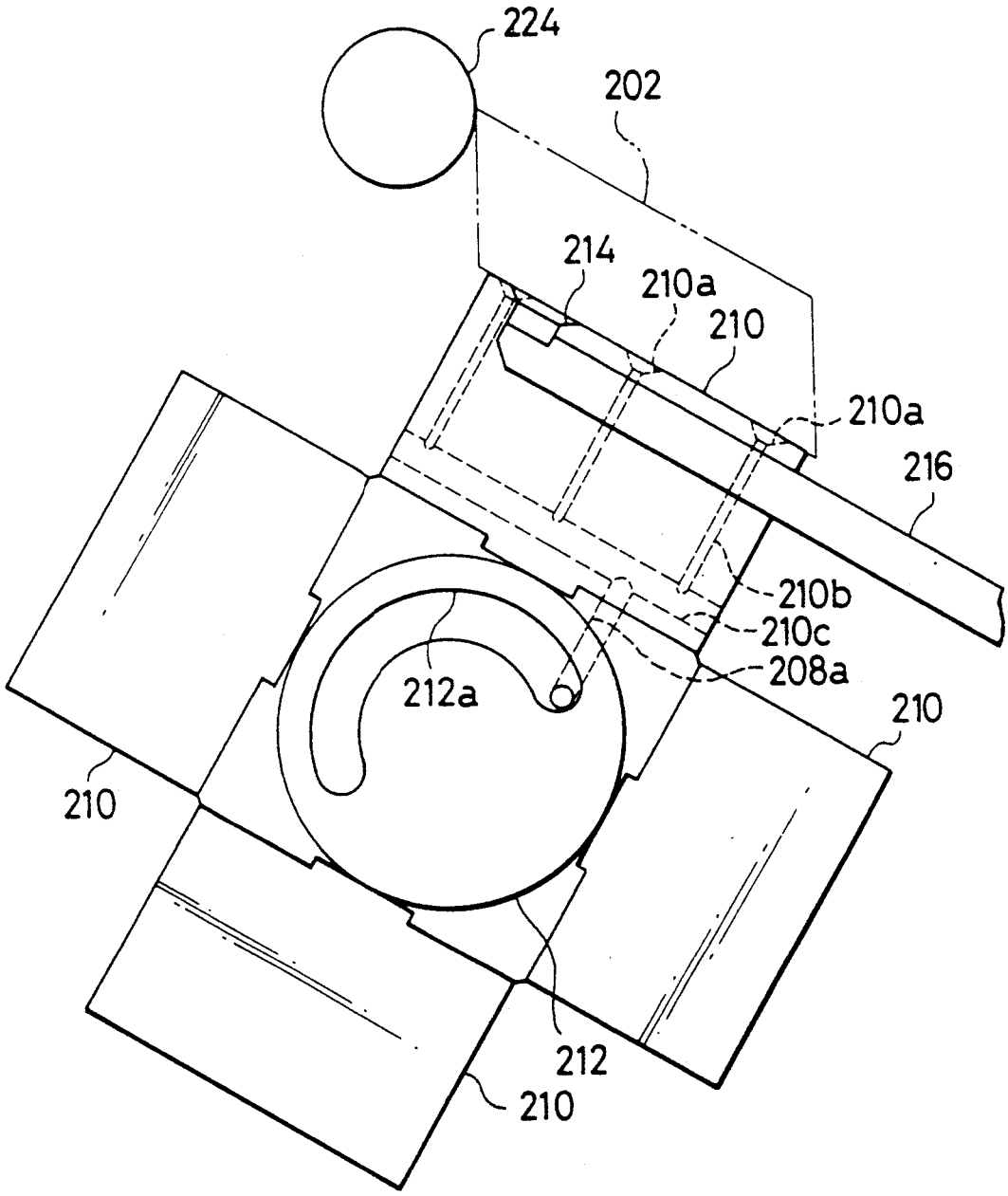

FIGS. 12–14 illustrate another example of the carton takeoff unit for use in taking out carton blanks from the carton magazine. In the upper portion of this unit, a carton magazine 204 holding a plurality of carton blanks 202 is provided in an inclined state, a rotary drum 208 adapted to be turned around a horizontal shaft 206 being provided below the carton magazine 204.

The rotary drum 208 is provided with four equally spaced vacuum plates 210 on the outer circumferential portion thereof. These vacuum plates 210 are provided with a plurality of suction holes 210*a* in the outer portions thereof as shown in FIGS. 12 and 13. The suction holes 210*a* communicate with a vacuum passage 208*a* in the rotary drum 208 through inner passages 210*b*, 210*c* in the vacuum plates 210. A vacuum valve 212 around which the rotary drum 208 slidingly contacts is fixed to a side surface thereof. The vacuum valve 212 is provided with an arcuate vacuum supply bore 212*a*, and the vacuum passage 208*a* communicates with and is shut off from the vacuum supply bore 212*a* in the vacuum valve 212 in accordance with the rotation of the rotary drum 208, whereby vacuum is applied to the suction holes 210*a* in the vacuum plates 210.

Suction levers 216 with suckers 214 attached to the front end portions thereof are provided between the carton magazine 204 and a vacuum plate 210. The suction levers 216 are supported on support blocks 220 fixed to a rotary shaft 218, and they are turned up and down between the carton magazine 204 and a vacuum plate 210 in accordance with the upward and downward turning movements through a predetermined angle of the rotary shaft 218. The suction levers 216 are screwed at their base end portions 216*a* to screw shafts 222 supported rotatably on the support blocks 220, in such a manner that the positions of the suckers 214 can be regulated by turning the screw shafts 222.

Each vacuum plate 210 is provided in its upper portion with two recesses 210*d* in which the suction levers 216 and suckers 214 which have been turned toward the vacuum plate 210 can be fitted.

A roller 224 is provided in front of a position in which a vacuum plate 210 receives a carton blank 202 from the suckers 214 on the suction levers 216, and the carton blank 202 is unfolded by this roller 224. An arcuate fixed guide 226 is provided on the outer side of a path of the vacuum plates 210, and an unfolded carton blank 202 is guided thereby until the carton blank 202 has been delivered to carton fingers 208 of a conveyor.

The operation of the carton takeoff unit of the above-mentioned construction will now be described. First, the suction levers 216 is turned up, and the suckers 214 suck a carton blank 202 stored in the carton magazine 204. The suction levers 216 then start being turned down to take out the carton blank 202 sucked to the suckers. When the suction levers 216 are further turned down, the front end portion of the carton blank 202 impinges upon the roller 224, so that the carton blank is unfolded. The suction levers 216 fit as they are in the recesses 210*d* in a vacuum plate 210 turned so as to meet with these levers 216, and the carton blank 202 is released from the suction pressure from the suckers 214 to be sucked to the vacuum plate 210. The suction levers 216 enter the interior of the recesses 210*d* deeper temporarily than as shown in FIG. 12, whereby the releasing of the carton blank 202 from the suction force of the suckers 214 and the delivering of the carton blank 202 to a vacuum plate 210 are done smoothly.

When the vacuum plate 210 is turned counter-clockwise by the rotary drum 208, the carton blank 202 advances as it is pressed at its front surface by the roller 224, so that the carton blank is bent backward. When the carton blank 202 has passed the roller 224, it is unfolded substantially to a cross-sectionally rectangular shape. The carton blank 202 is then transferred downward as it is retained in this unfolded state by the guide 226, and delivered to the carton fingers 228 of the conveyor.

After the carton blank 202 is thus taken out in accordance with the turning of the takeoff means consisting of the suckers 214 and suction levers 216, the takeoff means is fitted in the recesses 210*d* in the vacuum plate 210 (transfer means), whereby the delivering and receiving of the carton blank 202 are carried out, this enabling the carton blank to be taken out, delivered and received stably.

The numbers and shapes of the suction levers 216, suckers 214, suction holes 210*a* and recesses 210*d* are not limited to those in the illustrated examples.

The present invention is not, of course, limited to the above embodiments; it may be modified in various ways within the scope of the appended claims.

The embodiments of the invention in which an exclusive property or privilege is claimed are defined as follows:

1. A cartoning apparatus for transferring four sided carton blanks from a carton magazine along a transfer path to an exit location and for simultaneously unfolding carton blanks that have at open ends thereof four flaps which are successively connected to each of the four sides of the carton blank, comprising:

takeoff means for sucking and taking out one by one carton blanks stored in a flat folded state in a carton magazine;

transfer means fixed to a rotary body for receiving and circularly transferring said carton blank which has been taken out by said takeoff means;

carton unfolding means for unfolding said carton blank retained by said transfer means;

first means for turning outward a first flap which is at one opened portion of a cross-sectionally rectangular unfolded carton blank and is on a leading side in the rotational direction of said rotary body, said first means being oriented along said transfer path of the carton blank to effect said outward movement of said first flap as said carton blank is moved by said transfer means toward the exit location; and second means for bending outward the three other flaps at said opened portion of said carton blank, said second means being oriented along said transfer path of the carton blank to effect said outward movement of the three other flaps as said carton blank is moved by said transfer means toward the exit location;

whereby the four flaps are outwardly turned during a transfer of the carton blank from said carton magazine to the exit location.

2. A cartoning apparatus according to claim 1, wherein said second means consists of a fixed guide against which the inner surfaces of the three other flaps at said opened portion of said carton blank are pressed.

3. A cartoning apparatus according to claim 1, wherein said second means consists of a rotary plate having an arcuate pressing portion.

4. A cartoning apparatus according to claim 1, wherein said transfer means consists of a vacuum plate which is fixed to the outer circumference of said rotary drum turned around a horizontal shaft, and which is provided with vacuum suction holes in the upper portion thereof.

5. A cartoning apparatus according to claim 4, wherein said vacuum plate is provided at the end portion thereof which is on the leading side in the rotational direction of said vacuum plate with a stopper for positioning said carton blank.

6. A cartoning apparatus according to claim 4, wherein said carton unfolding means has an arm provided on said rotary drum and adapted to be turned with said rotary drum from the trailing side of said vacuum plate and knocks the trailing portion of said carton blank sucked to said vacuum plate, whereby said carton blank is unfolded.

7. A cartoning apparatus according to claim 1, wherein said first means is provided with an interference member adapted to be moved in substantially the same direction as and at a speed higher than that of said carton blank to impinge upon said first flap thereof.

8. A cartoning apparatus according to claim 1, wherein said apparatus is further provided with a means for turning up inward the flaps of said carton blank which are at an opposite end of said opening thereof.

* * * * *